US009096994B2

(12) United States Patent
Staade et al.

(10) Patent No.: US 9,096,994 B2
(45) Date of Patent: Aug. 4, 2015

(54) BOTTOM MOUNT BLADE POSITIONING ASSEMBLY FOR A MOTOR GRADER

(75) Inventors: Dustin T. Staade, Dubuque, IA (US); Neil V. Harber, Holy Cross, IA (US); Nathan J. Horstman, Durango, IA (US)

(73) Assignee: DEERE & COMPANY, Moline, IL (US)

( * ) Notice: Subject to any disclaimer, the term of this patent is extended or adjusted under 35 U.S.C. 154(b) by 123 days.

(21) Appl. No.: 13/397,119

(22) Filed: Feb. 15, 2012

(65) Prior Publication Data

US 2013/0206432 A1 Aug. 15, 2013

(51) Int. Cl.
*E02F 3/76* (2006.01)

(52) U.S. Cl.
CPC ..... *E02F 3/7672* (2013.01); *E02F 3/765* (2013.01); *E02F 3/7677* (2013.01); *E02F 3/7681* (2013.01)

(58) Field of Classification Search
CPC ..... E02F 3/765; E02F 3/764; E02F 3/7645; E02F 3/7677
USPC ..... 172/789, 793
See application file for complete search history.

(56) References Cited

U.S. PATENT DOCUMENTS

| | | | | | |
|---|---|---|---|---|---|
| 2,292,241 | A * | 8/1942 | Reeves | 172/781 |
| 2,655,743 | A * | 10/1953 | Ross | 172/793 |
| 3,149,429 | A * | 9/1964 | Martin | 37/428 |
| 3,448,816 | A * | 6/1969 | Beals et al. | 172/793 |
| 3,454,110 | A * | 7/1969 | Hanser | 172/793 |
| 3,550,692 | A * | 12/1970 | Hart | 172/793 |
| 3,739,861 | A * | 6/1973 | Johnson et al. | 172/793 |
| 3,986,563 | A | 10/1976 | Stubben | |
| 4,340,119 | A * | 7/1982 | MacDonald | 172/789 |
| 4,696,350 | A | 9/1987 | Ruhter et al. | |
| 5,076,370 | A | 12/1991 | Stubben et al. | |
| 7,575,068 | B2 | 8/2009 | Stubben | |
| 7,647,983 | B2 * | 1/2010 | Gharsalli | 172/793 |
| 7,874,377 | B1 | 1/2011 | Graeve | |
| 7,980,319 | B2 * | 7/2011 | Maeda | 172/789 |
| 2008/0185162 | A1 * | 8/2008 | Maeda | 172/781 |

* cited by examiner

*Primary Examiner* — Thomas B Will
*Assistant Examiner* — Joel F. Mitchell

(57) ABSTRACT

A motor grader includes a base unit and a blade positioning assembly. The base unit has a main frame. The blade positioning assembly includes a pivot member attached to and extending downwardly from the main frame, and a blade lift member attached to a bottom end of the pivot member.

10 Claims, 6 Drawing Sheets

BOTTOM MOUNT BLADE POSITIONING ASSEMBLY FOR A MOTOR GRADER

FIELD OF THE INVENTION

The present invention relates to motor graders, and, more particularly, to blade positioning linkages used with such motor graders.

BACKGROUND OF THE INVENTION

A motor grader is used to rough or finish grade an earth surface and includes a base unit with a main frame supporting traction wheels, operator cab, engine compartment, transmission, and a belly mounted (moldboard) blade. The blade extends downwardly from a circle drive arrangement which adjusts the angular orientation of the blade relative to a generally vertical axis. The circle drive arrangement is movably connected with the main frame at the front end. A blade positioning linkage attached to the main frame interconnects with the rear of the circle drive arrangement via a pair of blade positioning cylinders.

When using a motor grader it is important to have as much visibility as possible to and around the front axle and tires, as well as the blade. A blade positioning linkage having deficiencies in visibility to and around the front axle and tires causes the operator to lean or adjust his position in the seat to gain the visibility needed to perform certain tasks. It is also important to see out over the main frame to be able to see objects in the machines path. Visibility is impaired with a blade positioning linkage that wraps completely around the main frame.

Conventional blade positioning linkages typically either use a 4-bar type linkage with sculpted arms to hold the blade positioning cylinders or use a single sculpted piece that is attached to and completely wraps around the main frame. Examples of blade positioning linkages are disclosed in U.S. Pat. No. 4,696,350 (Ruhter et al.) and U.S. Pat. No. 3,986,563 (Stubben), each of which are assigned to the assignee of the present invention.

What is needed in the art is a blade positioning assembly which allows movement of the blade relative to the main frame while at the same time providing increased visibility to the blade and front axle.

SUMMARY

The present invention provides a blade positioning assembly that is mounted to the underside of the main frame. A pivot member in the form of a mounting ring is attached to the bottom of the main frame. A blade lift member is attached to the bottom of the mounting ring to keep the blade lift member in line with the axle and thereby allow for more visibility around the blade lift member, front axle and tires.

The invention in one form is directed to a motor grader including a base unit and a blade positioning assembly. The base unit has a main frame. The blade positioning assembly includes a pivot member attached to and extending downwardly from the main frame, and a blade lift member attached to a bottom end of the pivot member.

The invention in another form is directed to a blade positioning assembly for use in a motor grader having a longitudinally extending main frame. The blade positioning assembly includes a pivot member attachable to a bottom side of the main frame, and a blade lift member attached to a bottom end of the pivot member and pivotally movable relative to the pivot member.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates an embodiment of the invention, in one form, and such exemplification is not to be construed as limiting the scope of the invention in any manner.

DETAILED DESCRIPTION

Figure 1:
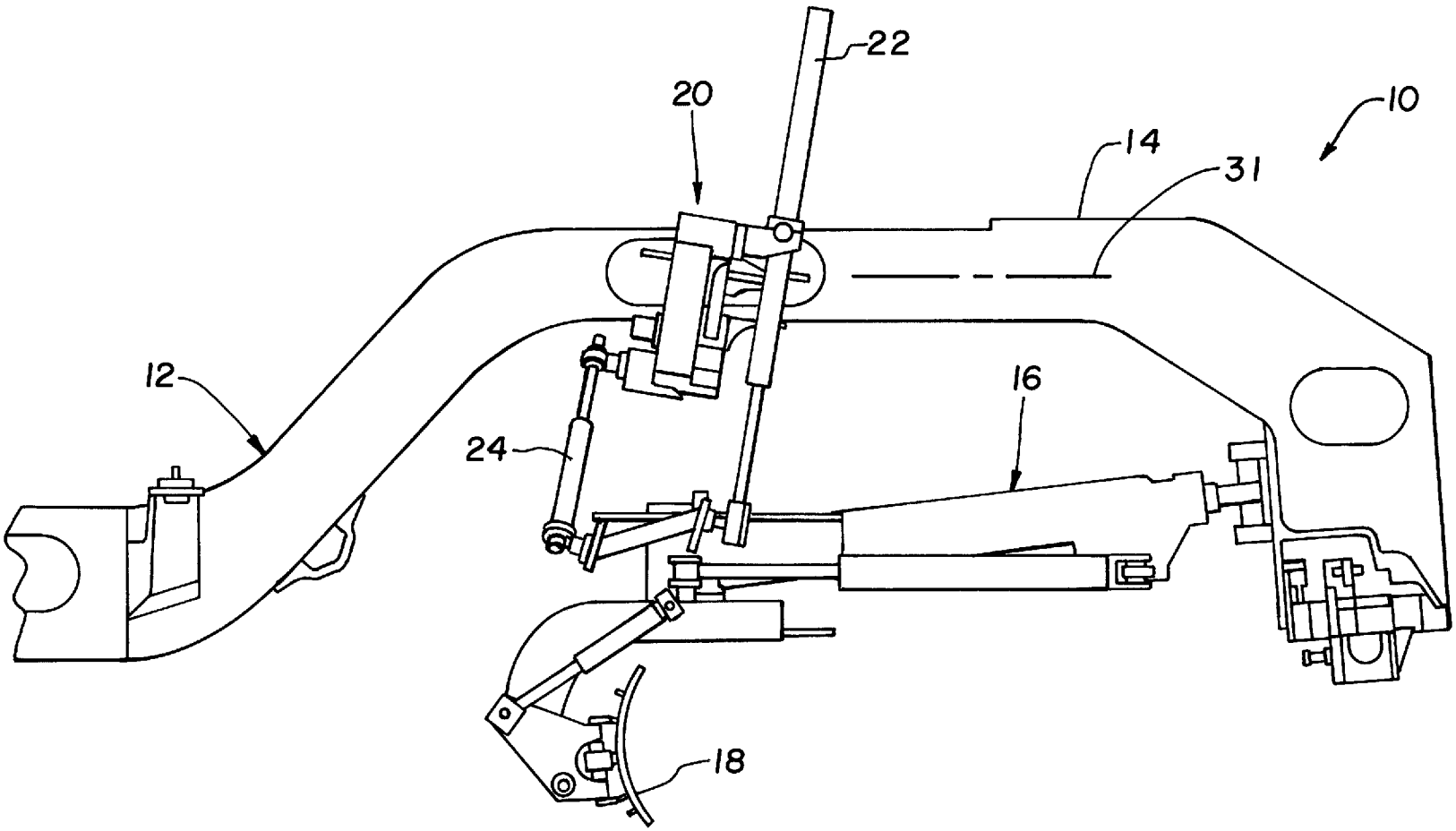
FIG. 1 is a side view of a portion of a motor grader, including an embodiment of a blade positioning assembly of the present invention.
Figure 2:
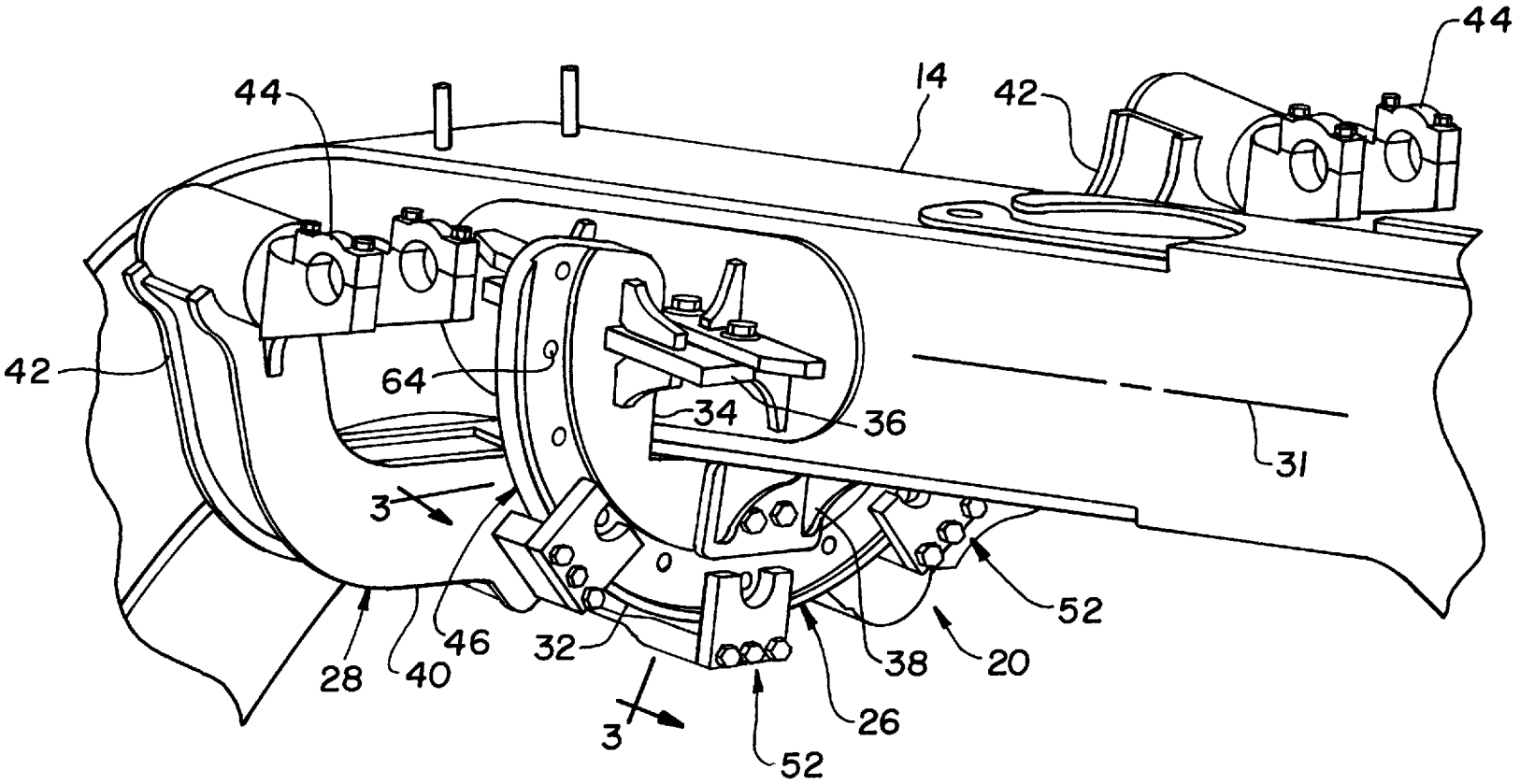
FIG. 2 is a perspective view of the blade positioning assembly shown in FIG. 1 while attached to the main frame of the motor grader.

Referring now to the drawings, and more particularly to FIGS. 1 and 2, there is shown a portion of a motor grader 10 which includes a base unit 12 having a longitudinally extending main frame 14 which supports an operator cab, engine compartment, transmission, and wheels (not visible). Main frame 14 also supports a circle drive arrangement 16, moldboard blade 18 and blade positioning assembly 20. A pair of blade lift cylinders 22 interconnect blade positioning assembly 20 with circle drive arrangement 16 and effect selective up-and-down movement of either end of blade 18. A lateral shift cylinder 24 also interconnects blade positioning assembly 20 with circle drive arrangement 16 and effects selective lateral side-to-side movement of blade 18.

Referring now to FIGS. 2-5, blade positioning assembly 20 will be described in greater detail. Blade positioning assembly 20 generally includes a pivot member 26 and blade lift member 28. Pivot member 26 is directly attached to the bottom side of mainframe 14 and is configured to allow blade lift member 28 to be pivoted relative to pivot member 26 at a select angular orientation about a pivot axis 30. In the illustrated embodiment, pivot member 26 is configured as a generally U-shaped mounting ring with a semi-circular bottom surface 32 which is positioned concentrically about pivot axis 30. Pivot axis 30 in turn lies generally parallel to the longitudinal axis 31 of mainframe 14. Pivot member 26 also includes a generally square opening 34 which is positioned radially inward from bottom surface 32. Opening 34 is sized and shaped to allow pivot member 26 to slide over and around main frame 14 for attachment with main frame 14. To that end, flanges 36 extending from pivot member 26 allow pivot member 26 to be bolted or otherwise fastened to main frame 14. An L-bracket 38 is bolted to the bottom of pivot member 26 and main frame 14.

Figure 3:
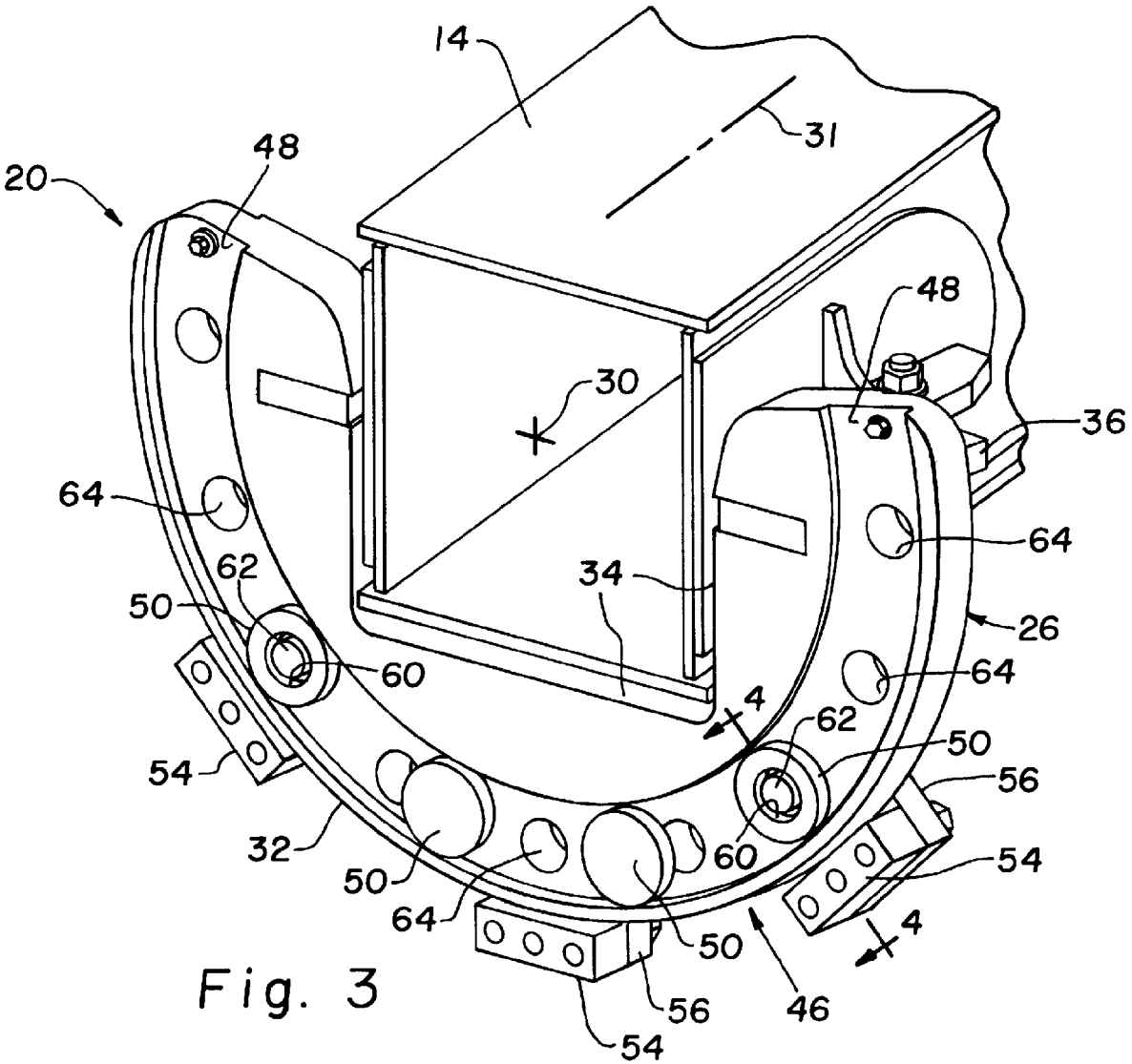
FIG. 3 is a sectional, perspective view of the blade positioning assembly shown in FIGS. 1 and 2, taken along line 3-3 in FIG. 2.

Blade lift member 28 is attached to the bottom end of pivot member 26 to improve the visibility to the front axle and blade 18 (FIGS. 2 and 3). Blade lift member 28 is generally U-shaped with a pair of opposite ends which are respectively configured for attachment with a blade lift cylinder 22. More particularly, blade lift member 28 includes a cross arm 40 and a pair of upwardly extending distal arms 42 at each end of cross arm 40. At the upper end of each distal arm 42 is a yoke arrangement 44 allowing attachment with a respective blade lift cylinder 22.

Blade lift member 28 is selectively pivotally movable relative to pivot member 26. To accomplish the pivotal movement therebetween, an arcuate mating groove arrangement 46 includes a groove 48 with a raised peripheral lip formed in the rear surface of pivot member 26 with a radius of curvature which is generally parallel to bottom surface 32 (FIG. 3). Arcuate mating groove arrangement 46 also includes a plurality of ring-shaped bosses 50 which extend forwardly from blade lift member 28 on the face adjacent pivot member 26 which are received within groove 48 to engage and move along the actuate path of the peripheral lip. In the illustrated embodiment, blade lift member 28 includes four forwardly extending bosses 50 which are received within groove 48. The size, shape and location of groove 48, as well as the size, shape, number and relative placement of bosses 50 are configured to allow the pivotal movement between pivot member 26 and blade lift member 28.

A plurality of retainers 52 retain blade lift member 28 to pivot member 26. Each retainer 52 includes a forwardly extending lug 54 and an attached radially extending ear 56. Retainers 52 retain the plurality of bosses 50 within arcuate groove 48 to thereby retain blade lift member 28 to pivot member 26.

Figure 4:
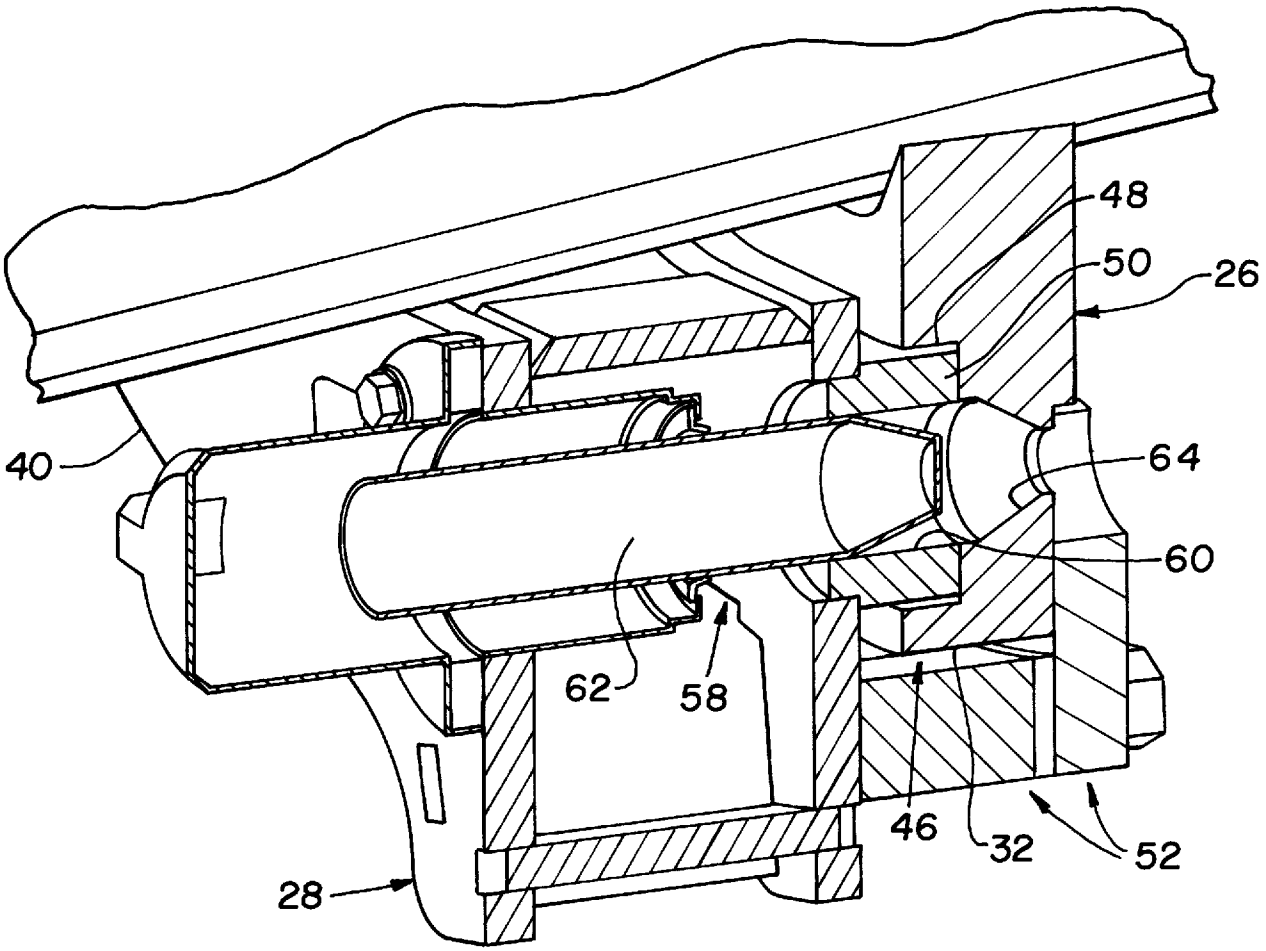
FIG. 4 is a sectional, perspective view of the blade positioning assembly shown in FIGS. 1-3, taken along line 4-4 in FIG. 3.
Figure 5:
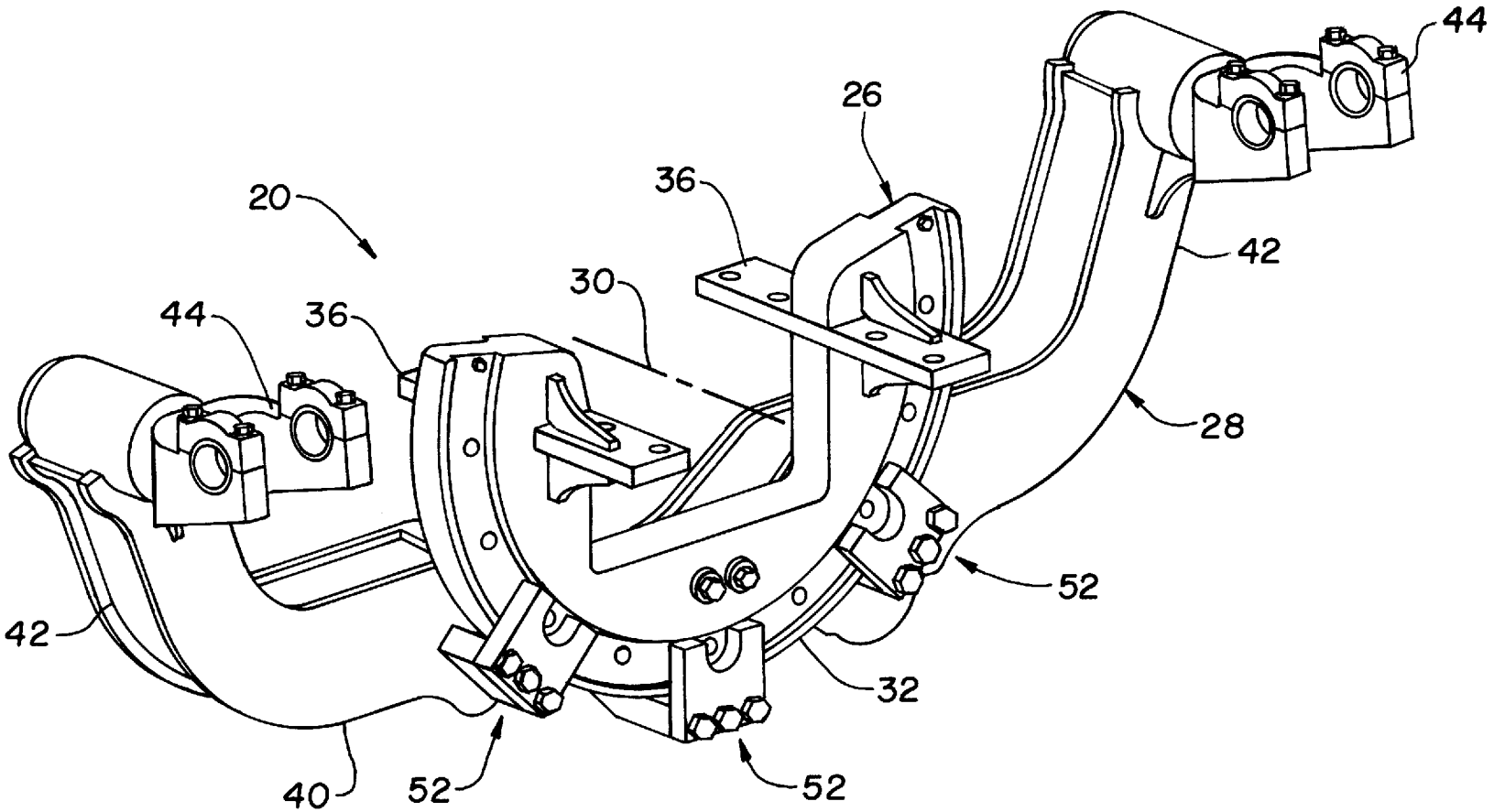
FIG. 5 is a perspective view of the blade positioning assembly shown in FIGS. 1-4 while detached from the main frame of the motor grader.

Blade positioning assembly 20 also includes one or more mechanical stops 58 for locking blade lift member 28 at a selected pivotal or angular location relative to pivot member 26. In the illustrated embodiment, two of the four forwardly extending bosses 50 have a central hole 60 through which a locking pin 62 passes and is received within a corresponding one of a plurality of holes 64 formed in pivot member 26 (FIGS. 3 and 4). Each hole 64 may have a tapered profile as illustrated which mates with a corresponding taper at the leading end of a locking pin 62, thereby providing a tolerance fit and assisting locking between blade lift member 28 and pivot member 26.

Figure 6:
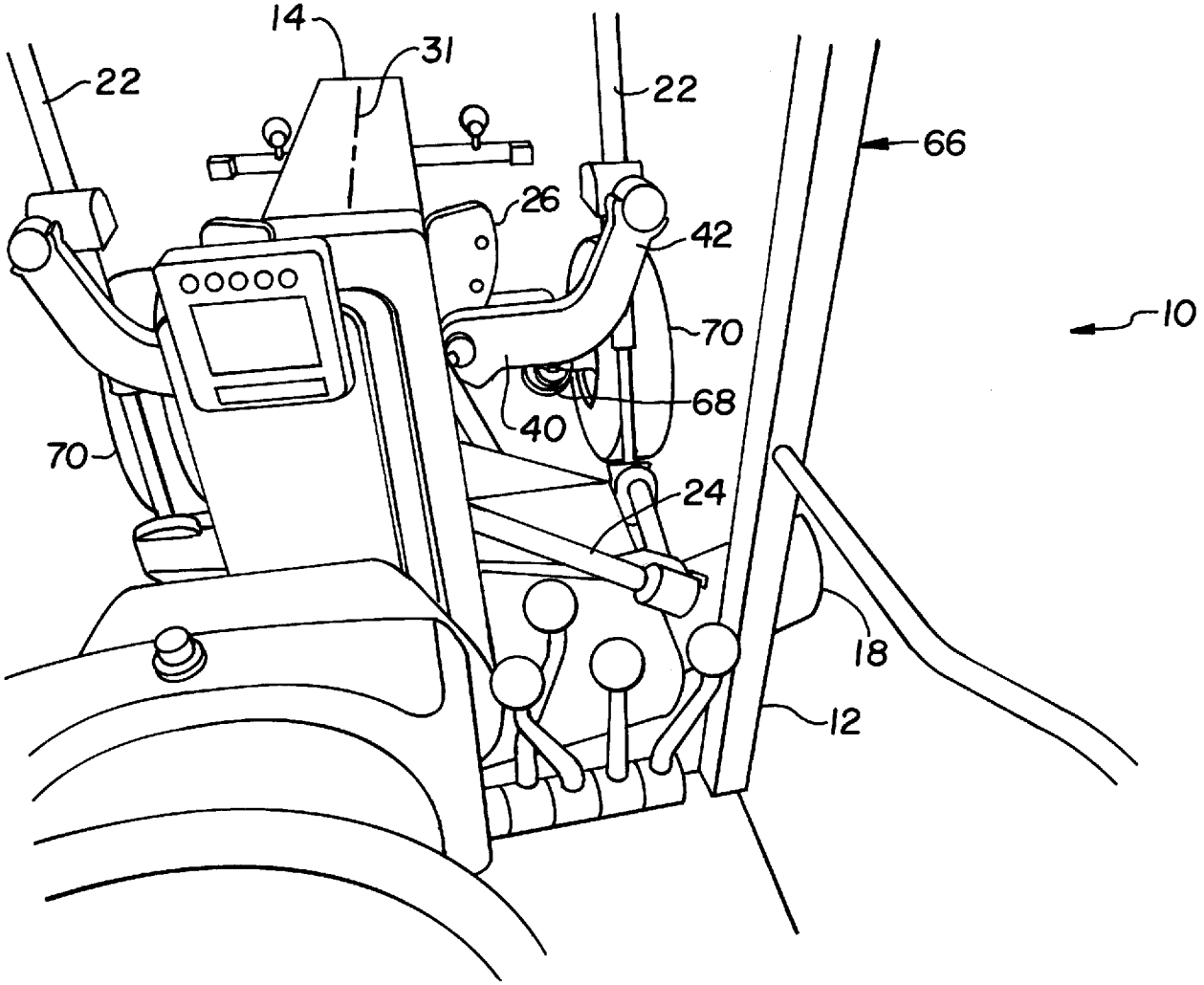
FIG. 6 is a perspective view of the blade positioning assembly shown in FIGS. 1-5 from an operator's perspective while seated in an operator cab.

Referring now to FIG. 6, there is shown a perspective view of the blade positioning assembly 20 from an operator's perspective while seated in an operator cab 66. As is apparent, blade 18 and front axle 68 are not in the same line of sight from the operator's perspective. Blade lift member 28 is attached to mainframe 14 and configured such that cross arm 40 generally aligns with front axle 68. Moreover, distal arms 42 generally align with a corresponding front wheel 70. Configuring blade positioning assembly 20 in this manner and positioning blade positioning assembly 20 to generally align with the front axle 68 and wheels 70 improves the visibility while operating motor grader 10.

In summary, blade lift member 28 attaches to the bottom of pivot member 26 that is attached to the bottom of main frame 14. Blade positioning assembly 20 uses retainers 52 on one side of the pivot member 26 and a guide in the form of arcuate mating groove arrangement 46 on the other side to allow it to rotate around pivot member 26 while being retained. Blade positioning assembly 20 uses one or more locking pins 62 to hold it in place at discrete angles. Moving the locking pin holes 64 closer together near the bottom of the main frame allows the distance between the locking pin holes to shrink and allows for removing the upper part of the pivot member 26 material since it is no longer needed for retention of the blade lift member 28. This provides better visibility straight ahead over the main frame 14.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. In a motor grader having a longitudinally extending main frame, a blade positioning assembly comprising:

a pivot member non-pivotally attached to and extending downwardly from said main frame, said pivot member including an arcuate groove in a surface of said pivot member;

a blade lift member attached to a bottom end of said pivot member, a selectively pivotal movement of said blade lift member relative to said pivot member corresponding to movement of a blade of said motor grader relative to said main frame;

a plurality of bosses fixed with respect to said blade lift member, said plurality of bosses extending into said arcuate groove in said surface of said pivot member and thereby providing a plurality of distinct contact points between said plurality of bosses and said pivot member in order to directly support said blade lift member, wherein selective movement of said bosses along said arcuate groove corresponds to said selectively pivotal movement of said blade lift member relative to said pivot member;

a plurality of retainers fixed with respect to said blade lift member, each of said retainers including a lug extending away from said blade lift member and an ear extending away from said lug and toward said pivot member, said lug and said ear of each of said retainers securing said plurality of bosses of said blade lift member within said arcuate groove of said pivot member.

2. The blade positioning assembly of claim 1, wherein said pivot member is a generally U-shaped mounting ring.

3. The blade positioning assembly of claim 2, wherein said mounting ring has a semi-circular bottom surface.

4. The blade positioning assembly of claim 1, further including at least one mechanical stop for locking said blade lift member at a selected pivotal location relative to said pivot member.

5. The blade positioning assembly of claim 1, wherein said blade lift member is generally U-shaped with a pair of opposite ends, each of said opposite ends respectively configured for attachment with a blade lift cylinder.

6. The blade positioning assembly of claim 5, wherein said generally U-shaped blade lift member has a cross arm, and a pair of upwardly extending distal arms at each end.

7. The blade positioning assembly of claim 6, wherein, from a perspective from within an operator's cab included in said motor grader, said cross arm generally aligns visually with a front axle of said motor grader and said upwardly extending distal arms generally align visually, respectively, with front wheels attached to said axle.

8. The blade positioning assembly of claim 4, wherein said at least one mechanical stop includes a hole and a locking pin configured to be inserted in said hole, said hole being located below a horizontal plane extending through said bottom portion of said main frame.

9. A motor grader, comprising:

a base unit having a longitudinally extending main frame;

a pivot member non-pivotally attached to and extending downwardly from said main frame; and a blade lift member directly coupled to a bottom end of said pivot member and thereby supported by said main frame via said pivot member;

wherein, while said blade lift member is directly coupled to said bottom end of said pivot member and thereby supported by said main frame, said blade lift member is selectively pivotally movable relative to said pivot member, a selectively pivotal movement of said blade lift member relative to said pivot member corresponding to movement of a blade of said motor grader relative to said main frame;

wherein said blade lift member and said pivot member are connected via an arcuate mating groove arrangement that allows said pivotal movement of said blade lift member;

wherein said arcuate mating groove arrangement includes an arcuate groove and at least one projection received within said arcuate groove, said at least one projection thereby supporting said blade lift member with respect to said pivot member;

wherein said at least one projection moves in an arcuate path along said arcuate groove to allow said pivotal movement of said blade lift member; and further including at least one mechanical stop for locking said blade lift member at a selected pivotal location relative to said pivot member, wherein said at least one mechanical stop includes a plurality of holes and a locking pin configured to be inserted in each of said plurality of holes, said plurality of holes being arranged along said arcuate groove and at least one of said holes being located below a horizontal plane extending through said bottom portion of said main frame.

10. A motor grader, comprising:

a base unit having a longitudinally extending main frame;

a pivot member fixedly attached to said main frame, said pivot member including a surface with an arcuate groove; and a blade lift member including one or more projections, said one or more projections extending from a surface of said blade lift member into said arcuate groove, wherein said blade lift member is supported by said main frame via said extending of said one or more projections into said arcuate groove;

a plurality of locking holes arranged along said arcuate groove; and a locking pin configured for insertion into each of said locking holes;

wherein said one or more projections are movable in an arcuate path along a portion of said arcuate groove while said blade lift member is supported by said main frame via said extending of said one or more projections into said arcuate groove, and wherein moving said one or more projections along said arcuate path corresponds to movement, relative to said main frame, of said blade lift member and of a blade of said motor grader; and wherein said insertion of said locking pin into any one of said locking holes locks said blade lift member, respectively, in a one of a plurality of orientations with respect to said pivot member.

* * * * *